US006714857B2

(12) United States Patent
Kapolka et al.

(10) Patent No.: US 6,714,857 B2
(45) Date of Patent: Mar. 30, 2004

(54) SYSTEM FOR REMOTE MONITORING OF A VEHICLE AND METHOD OF DETERMINING VEHICLE MILEAGE, JURISDICTION CROSSING AND FUEL CONSUMPTION

(75) Inventors: Michael Kapolka, Sterling Heights, MI (US); Sam Chang, West Bloomfield, MI (US); Andrew Smith, Cedar Rapids, IA (US)

(73) Assignee: NNT, Inc., Sterling Heights, MI (US)

( * ) Notice: Subject to any disclaimer, the term of this patent is extended or adjusted under 35 U.S.C. 154(b) by 0 days.

(21) Appl. No.: 10/082,847

(22) Filed: Feb. 26, 2002

(65) Prior Publication Data

US 2003/0163249 A1 Aug. 28, 2003

(51) Int. Cl.[7] ..... G06G 7/73

(52) U.S. Cl. ..... 701/123; 701/207; 701/209; 340/902; 340/991

(58) Field of Search ..... 701/104, 123, 701/209, 204, 213, 219, 300; 340/902, 989, 991

(56) References Cited

U.S. PATENT DOCUMENTS

| | | | | |
|---|---|---|---|---|
| 4,067,061 A | | 1/1978 | Juhasz | |
| 4,258,421 A | | 3/1981 | Juhasz et al. | |
| 4,630,292 A | | 12/1986 | Juricich et al. | |
| 4,677,429 A | | 6/1987 | Glotzbach | |
| 4,809,177 A | | 2/1989 | Windle et al. | |
| 4,926,331 A | | 5/1990 | Windle et al. | |
| 4,939,652 A | | 7/1990 | Steiner | |
| 5,068,656 A | * | 11/1991 | Sutherland | 340/989 |
| 5,337,236 A | | 8/1994 | Fogg et al. | |
| 5,359,528 A | | 10/1994 | Haendel et al. | |
| 5,579,233 A | | 11/1996 | Burns | |
| 5,612,875 A | | 3/1997 | Haendel et al. | |

(List continued on next page.)

FOREIGN PATENT DOCUMENTS

| | | |
|---|---|---|
| DE | 44 23 328 | 1/1996 |
| DE | 100 55 287 | 5/2002 |
| EP | 1 128 333 | 8/2001 |

OTHER PUBLICATIONS

Pub # 2001/0047244A1 which is US Ser. No. 09/911,485; filed Jul. 25, 2001.*

*Primary Examiner*—Gertrude A. Jeanglaude
(74) *Attorney, Agent, or Firm*—McDonnell Boehnen Hulbert & Berghoff

(57) ABSTRACT

A monitoring system that determines vehicle position and fuel consumption in a jurisdiction, and jurisdiction crossings. The system includes a vehicle having a fuel reservoir from which fuel is consumed as an energy source. The system also includes a positioning system for generating the present position information of the vehicle. The information includes latitude and longitude data points. Additionally, the system includes a fuel monitoring device in the fuel reservoir, whereby the fuel monitoring means generates information including the present level of fuel in the fuel reservoir. Also, a data collection device for collecting the present position information and the present level of fuel information. Finally, the system includes a processor located at a remote site from the vehicle, the processor receives data from the collecting device. The processor determines when the vehicle crosses a jurisdiction border and computes the fuel consumption in the jurisdiction, the fuel consumption data can then be later used to compute the fuel tax.

21 Claims, 10 Drawing Sheets

U.S. PATENT DOCUMENTS

| | | | | |
|---|---|---|---|---|
| 5,648,768 | A | | 7/1997 | Bouve |
| 5,680,328 | A | | 10/1997 | Skorupski et al. |
| 5,694,322 | A | | 12/1997 | Westerlage et al. |
| 5,721,678 | A | | 2/1998 | Widl |
| 5,729,458 | A | | 3/1998 | Poppen |
| 5,742,915 | A | | 4/1998 | Stafford |
| 5,787,373 | A | | 7/1998 | Migues et al. |
| 5,864,831 | A | | 1/1999 | Schuessler |
| 5,917,434 | A | | 6/1999 | Murphy |
| 5,928,291 | A | | 7/1999 | Jenkins et al. |
| 5,954,773 | A | | 9/1999 | Luper |
| 5,974,356 | A | | 10/1999 | Doyle et al. |
| 6,008,740 | A | | 12/1999 | Hopkins |
| 6,026,384 | A | | 2/2000 | Poppen |
| 6,064,929 | A | | 5/2000 | Migues |
| 6,087,965 | A | | 7/2000 | Murphy |
| 6,088,650 | A | | 7/2000 | Schipper et al. |
| 6,108,591 | A | | 8/2000 | Segal et al. |
| 6,151,549 | A | * | 11/2000 | Andrews et al. ..... 701/115 |
| 6,167,333 | A | | 12/2000 | Gehlot |
| 6,181,995 | B1 | | 1/2001 | Luper et al. |
| 6,185,501 | B1 | | 2/2001 | Smith et al. |
| 6,195,023 | B1 | | 2/2001 | Walsh et al. |
| 6,226,577 | B1 | | 5/2001 | Yeo |
| 6,253,129 | B1 | | 6/2001 | Jenkins et al. |
| 6,259,988 | B1 | | 7/2001 | Galkowski et al. |
| 6,278,935 | B1 | | 8/2001 | Kaplan et al. |
| 6,285,953 | B1 | * | 9/2001 | Harrison et al. ..... 701/213 |
| 6,317,668 | B1 | | 11/2001 | Thibault |
| 6,453,731 | B1 | * | 9/2002 | Yaegashi ..... 73/113 |
| 2001/0018628 | A1 | | 8/2001 | Jenkins et al. |
| 2001/0020204 | A1 | | 9/2001 | Runyon et al. |

* cited by examiner

SYSTEM FOR REMOTE MONITORING OF A VEHICLE AND METHOD OF DETERMINING VEHICLE MILEAGE, JURISDICTION CROSSING AND FUEL CONSUMPTION

FIELD OF THE INVENTION

This invention relates to the field of commercial vehicle management devices, in particular, to an electronic system for monitoring the position of vehicles at a remote site, and more particularly, to an improved system for determining vehicle mileage, jurisdictional crossing and subsequently determining the fuel consumed in the respective jurisdiction for purposes of determining jurisdictional fuel tax.

BACKGROUND OF THE INVENTION

In today's trucking industry, trucks traveling in more than one state are required to have their road use tax apportioned among the states in which they travel. Typically, truck drivers maintain log books which show the time and routes they drive. Oftentimes, the information entered into these books is done after the fact, and as a result may be records that are either inaccurate, or have accidental omissions. In addition, these documents could be altered or falsified by the driver with little chance of detection.

Consequently, the state taxing authorities often question the accuracy of the driver log books, and assess a road use tax based upon their revised estimate of the number of miles driven within their state.

One method which has been proposed for enhancing the reliability of information relating to the mileage a truck travels in a particular state includes transponders at the state boundaries of interstate highways which are used to record entries and exits from states. While this method might be able to provide some enhanced reliability, it does have several serious drawbacks. First, the use of transponders requires the states to spend funds for permanent infrastructure, and it further requires an agreement and coordination between the states to have compatible transponders. Additionally, the use of transponders restricts the ability of the system to monitor entries and exits on unprotected secondary roads.

Another method is disclosed in U.S. Pat. No. 5,928,291 by Jenkins et al. This patent discloses a commercial vehicle fleet management system which integrates a vehicle on-board computer, a process positioning system, and communications system to provide automated calculating and reporting of jurisdictional fuel taxes, road use taxes, vehicle registration fees, and the like. Also, disclosed is an online mobile communications system and a system for monitoring commercial vehicle efficiency and vehicle and driver performance.

Although the system described in the '291 patent overcomes many of the problems described with respect to the transponders, this system still has many drawbacks. First, the system requires an on-board memory device and an on-board recording system. Therefore, this system does not allow for the constant real-time monitoring of the vehicle at a remote site. Second, the system employs a removable data storage media, allowing the vehicle to vehicle transfer of trip event data for a given operator. Although this is useful in tracking driver time, the removable storage media could be lost or damaged, and poses a management problem when one wants to gather all of the information about a particular vehicle. Lastly, since the state line crossing events are computed on-board, a vehicle accident may damage or destroy the on-board computer, which in turn would cause all the state line crossing data to be lost.

Therefore, there is still a need in the art for a system for remote monitoring of a vehicle and method of determining vehicle mileage, jurisdiction crossing and fuel consumption that does not require states to install permanent infrastructure, that does not require an agreement and coordination between the states to have compatible transponders, that functions properly on secondary roads, that does not require an on-board memory device and an on-board recording system, that does not employ a removable data storage media, allowing the vehicle to vehicle transfer of trip event data for a given operator, and does not perform calculations on-board. A remote, unconditional electronic monitoring system that determines vehicle position and determines vehicle state line crossing and fuel consumption via a wireless link is therefore desired in the art.

SUMMARY OF THE INVENTION

The present invention relates to an electronic monitoring system that determines vehicle mileage and fuel consumption in a jurisdiction, and jurisdiction crossings. The system includes a vehicle having a fuel reservoir from which fuel is consumed as an energy source. The system also includes a positioning system for generating the present position information of the vehicle. The information includes latitude, longitude and vehicle bearing. Additionally, the system includes fuel monitoring devices in the fuel system, whereby the fuel monitoring means generates information including the present level of fuel in the fuel reservoir, the total fuel consumed by the vehicle, the total amount of fuel consumed while idling. Also, a data collection device for collecting the present position information and the present fuel information. Finally, the system includes a server located at a remote site from the vehicle, the server receives data from the collecting device via wireless communications. The server determines when the vehicle crosses a jurisdiction border and computes the fuel consumption in the jurisdiction.

The present invention also includes an electronic monitoring system that determines a jurisdictional crossing from a remote location. The system includes a vehicle, and a positioning system for generating present position information including latitude and longitude information of the vehicle. Also, a data collection device for collecting the present position information and a processor located remote from the vehicle. The processor receives data from the collecting device, and the processor determines when the vehicle crosses a jurisdiction border.

Therefore, it is an aspect of the present invention to provide a monitoring system that electronically determines vehicle mileage and fuel consumption in a jurisdiction, and jurisdiction crossings.

It is a further aspect of the present invention to provide a monitoring system that captures vehicle position and fuel consumption and transmits all information to a remote server, and does not record or save any calculated fuel or jurisdiction information on the vehicle.

It is a further aspect of the present invention to provide a monitoring system that determines vehicle mileage and fuel consumption in a jurisdiction, and jurisdiction crossings that does not require the use of a vehicle odometer.

It is a further aspect of the present invention to provide a monitoring system that determines vehicle mileage and fuel consumption in a jurisdiction, and jurisdiction crossings that does not require the use of removable data storage media, but allows the recordation of a given operator's trip record in a central location, remote from the vehicle, and is easily accessed from a central processor.

It is a further aspect of the present invention to provide a monitoring system that determines vehicle mileage and fuel consumption in a jurisdiction, and jurisdiction crossings that determines the route of the vehicle using longitude, latitude and bearing data points taken at regular time intervals, using a positioning system, and wirelessly transmits these data points to a remote server, and the remote server plots the route of the vehicle.

It is a further aspect of the present invention to provide a monitoring system that determines vehicle mileage and fuel consumption in a jurisdiction, and jurisdiction crossings and determines the fuel consumption by using data points that are taken from the fuel system at regular time intervals, these data points correspond to the vehicle location data points, and thus the fuel consumed at every point during the vehicle's route can be determined.

It is a further aspect of the present invention to provide a monitoring system that determines vehicle mileage and fuel consumption in a jurisdiction, and jurisdiction crossings that determines the location and time of a refueling event, as well as the change in fuel level resulting from the refueling event.

It is a further aspect of the present invention to provide a monitoring system that determines vehicle position and fuel consumption, that determines the location and time of a refueling event, as well as the amount of idle fuel used within a jurisdiction, and jurisdiction crossings.

It is a further aspect of the present invention to provide a monitoring system that determines vehicle position and fuel consumption, that determines the location and time of a refueling event, and determines the miles traveled within a jurisdiction, and jurisdiction crossings.

It is another aspect of the present invention to provide a monitoring system that determines vehicle mileage and fuel consumption in a jurisdiction, and jurisdiction crossings that does not require states to install permanent infrastructure.

It is another aspect of the present invention to provide a monitoring system that determines vehicle position and fuel consumption in a jurisdiction, and jurisdiction crossings that does not require an agreement and coordination between the states to have compatible transponders.

It is another aspect of the present invention to provide a monitoring system that determines vehicle position and fuel consumption in a jurisdiction, and jurisdiction crossings that functions properly on secondary roads.

It another aspect of the present invention to provide a monitoring system that determines vehicle position and fuel consumption in a jurisdiction, and jurisdiction crossings that is unconditional and transmits all fuel consumption and location information via a wireless link.

It is a further aspect of the present invention to provide a monitoring system that determines a jurisdictional crossing by a vehicle from a remote location.

These aspects of the invention are not meant to be exclusive and other features, aspects, and advantages of the present invention will be readily apparent to those of ordinary skill in the art when read in conjunction with the appended claims and accompanying drawings.

DETAILED DESCRIPTION OF THE INVENTION

Figure 1:
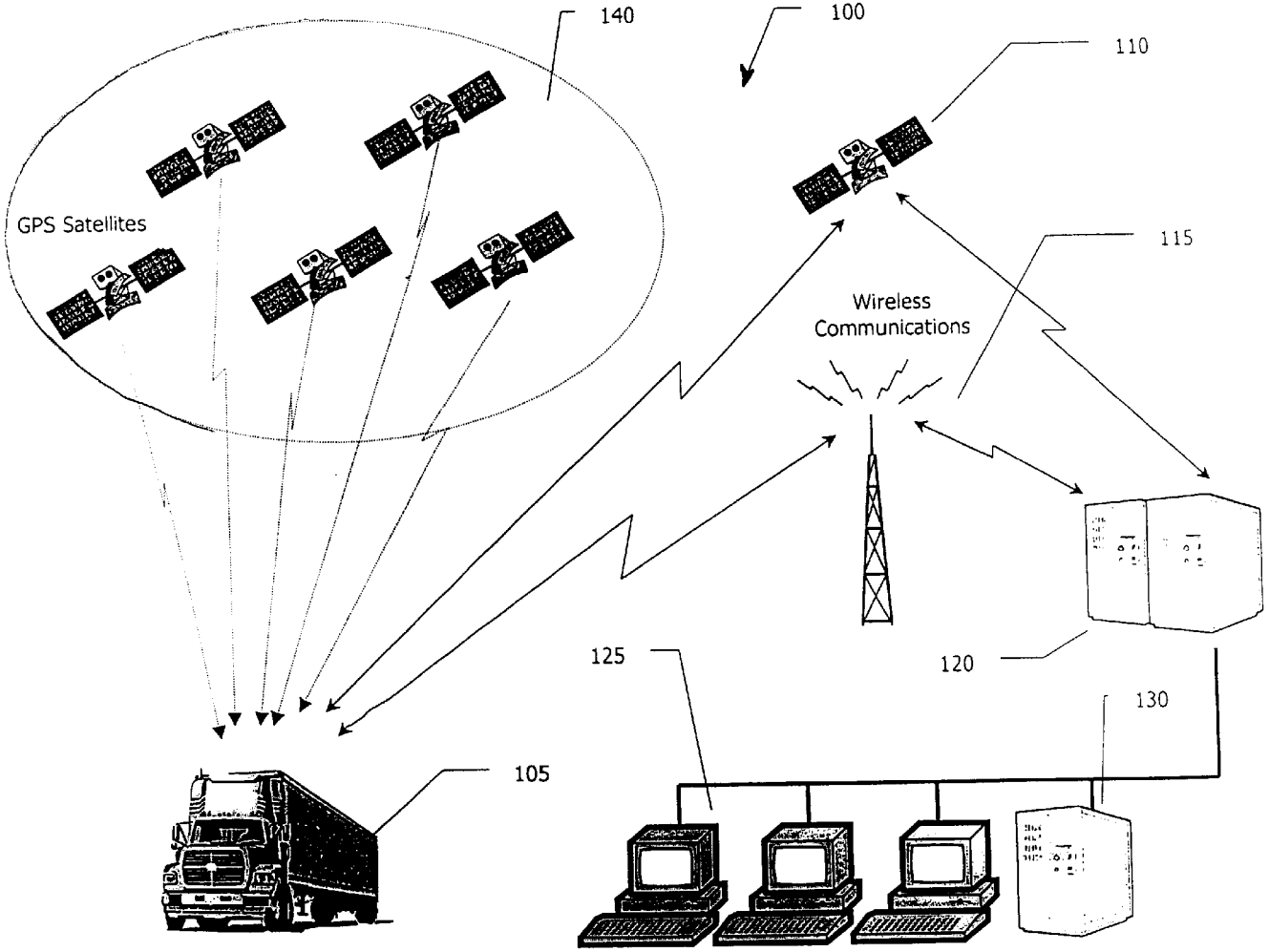
FIG. 1 is a diagrammatic representation of the data collection system according to the preferred embodiment of the present invention.

The present invention method is herein described as it relates to the commercial trucking industry. Although in the preferred embodiment, the present invention is intended for use in the commercial trucking industry, the present invention may also be used in relation to other vehicle operations, for example, air, water and land based vehicles. Additionally, the present invention can be employed in the non-commercial or the commercial based vehicle industry.

The present invention is a monitoring system that determines vehicle position and fuel consumption in a jurisdiction and jurisdiction crossings. The monitoring system includes elements located on the vehicle, as well as a remote server in communication with the vehicle via a wireless link. The server is intended to collect all of the data sent from all of the vehicles in the fleet. This server processes the data and produces vehicle route and vehicle fuel consumption information, as well as jurisdictional fuel information. Although the data is processed on a central server, all of the data sent from the vehicle to the processor can be accessed on the world wide web through a password protected web site. This information allows for fleet driver's and fleet managers to access and review the miles they have logged on a vehicle in a given amount of time. Also, allowing for a permanent record of all the fleet vehicles' and drivers' service. The present invention allows for the real-time recording of fuel consumption and vehicle route data. The vehicle route data allows for accurate assessment of miles traveled, and jurisdictional crossings. This system prevents driver log-book mistakes and fraud, and guarantees real-time permanent recording of vehicle route, fuel consumption data and jurisdiction crossings.

The invention uses information that is provided by one or more data communications links that are available in commercial vehicles being manufactured today. These communications links are used to enable components on the vehicle, such as engines, transmissions, braking systems, instrument clusters, driver display terminals, etc. to communicate and share information with each other and to provide a single access point for other activities such as diagnostic analysis, configuration or reprogramming purposes. Examples of such data communications links include Society of Engineers (SAE) standards J1708 and J1939. In support of these data communications link standards, supporting standards have been developed that describe the methods for obtaining data from these links, as well as the format of the data. An example of such a supporting standard is the J1587 standard published by the SAE.

The SAE's J1587 standard describes the notion of vehicle components being identified on the vehicle by specific Message Identifiers (MID's), and data parameters being identified by Parameter ID's (PID's). For example, data being sent from an engine is prefaced with MID number 128. A "Total Fuel Used" parameter ID is prefaced with PID number 250, followed by the actual data value.

This notion of MID's and PID's have been extended to other similar parameters used on vehicles, such as SAE J1939, the controller area network (CAN), ISO-9141, and others. Therefore, the method described in this invention can be applied similarly to vehicles or equipment equipped with other datastreams.

The primary source of information available on these datastreams comes from the vehicle components. These components depend upon reliable, accurate information to ensure efficient and reliable operation of the vehicle. Therefore, manufacturers of these components and their resultant measured values strive to ensure high reliability and accuracy. Therefore, the information provided can be regarded as reliable and accurate, and are thus suitable for determining trip and fuel consumption information such as total fuel used, and fuel level. The invention described utilizes parameters available on these data communications links to ensure reliable inputs to fuel information.

Referring first to FIG. 1, a diagram representing the data collection system of the preferred method of the present invention is shown. The system includes a vehicle 105 equipped with an on vehicle computer FIG. 2, 200. The vehicle 105 is a commercial truck, but in other embodiments, the vehicle 105 is any type of vehicle. The data collection system also includes one or more Wireless Communications systems 110, 115, for transferring commands and/or data between one or more vehicles 105 and a remote server 120. As can be seen from the drawing 100, the wireless communications system can be either satellite 110 or terrestrial 115 based.

The satellite-based positioning system 140 determines the present position of the vehicle in the form of longitude, latitude and bearing data points. In the preferred embodiment, the positioning system is a Global Positioning System (GPS), but in other embodiments the positioning device is any other positioning device such as LORAN. In the case where satellite based data communication is used 110, the system can use information provided by the data communications satellite 110 to determine vehicle location.

In the preferred embodiment of the invention, the remote server 120 is connected to a plurality of remote data terminals 125 or another server 130, that is typically located in a user location.

Figure 2:
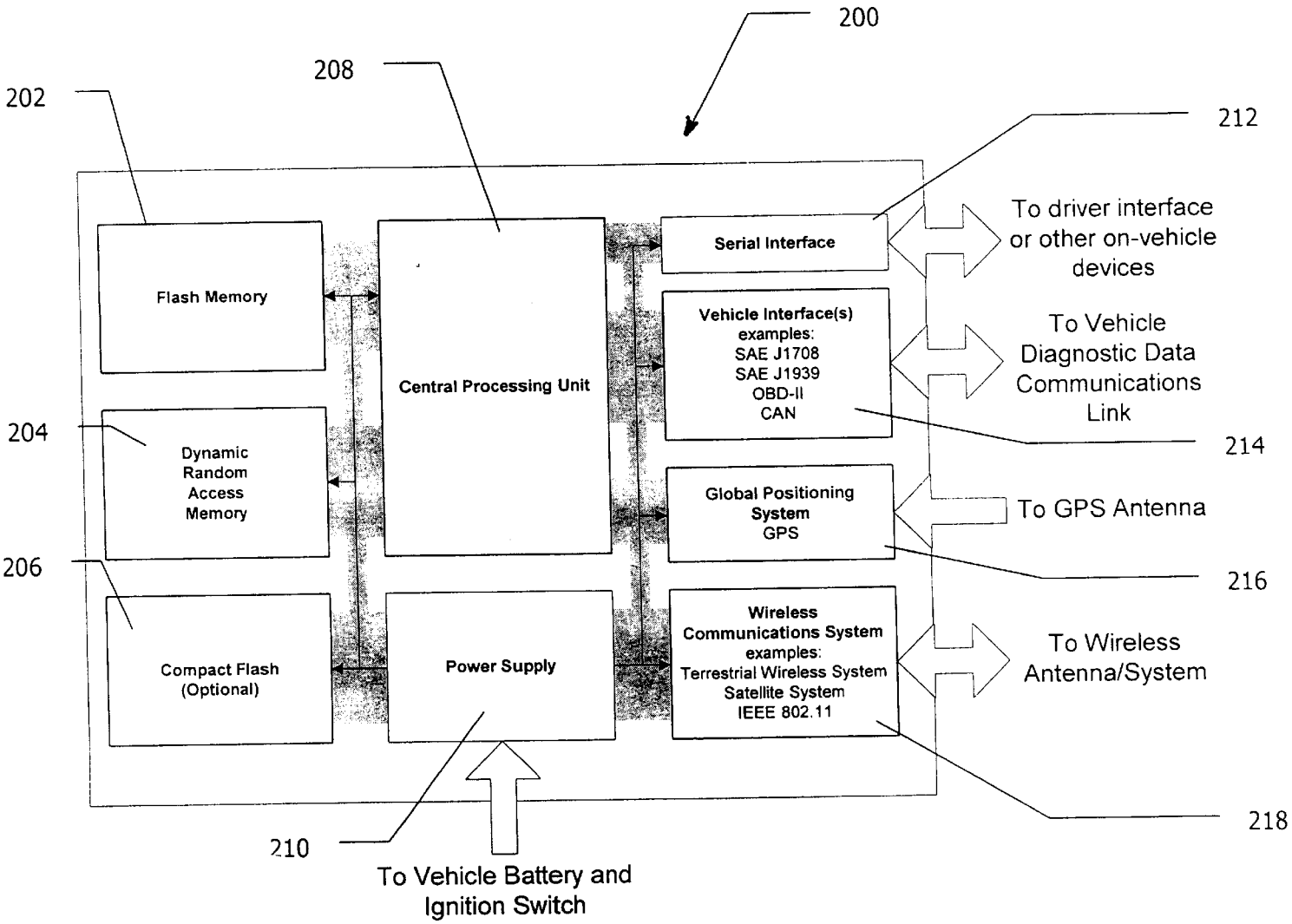
FIG. 2 is a block diagram of the on-vehicle computer according to the preferred embodiment of the present invention.

Referring now to FIG. 2, a block diagram of an embodiment of the on-vehicle computer 200 is shown. In the preferred embodiment, the on-vehicle computer is includes a Central Processing unit 208, used to run any software applications and to perform any data processing required; a Flash Memory 202, used for storing any required information and the software applications; a Dynamic Random Access Memory 204, used for temporary storage of any data or processing information; an optional Compact Flash card 206; a serial interface 212, which can be used as a communications means between a driver interface or other on-vehicle device and the on-vehicle computer 200; one or more vehicle interfaces 214, which are used by the on-vehicle computer 200 to communicate and monitor data stream activity between other on-vehicle computers; a Global Positioning System 216, used for determining the vehicle location and direction, and data and time information based upon calculation performed on data received from the GPS satellites 140; a Wireless Communications System 218, which is used for communications between the on-vehicle computer 200 and the remote server 120; and a Power Supply 210; which is used to power the on-vehicle computer 200 from the vehicle's electrical power source. It should be understood that the Global Positioning System 216 may not be required if the on-vehicle computer 200 is used in conjunction with a satellite based communications system 110 that is capable of providing vehicle position, bearing, date and time information to the on-vehicle computer 200. Finally, it should be understood by those skilled in the art that the on-vehicle computer 200 is merely representative of the system located on the vehicle, and could be rendered in alternative means.

Figure 3:
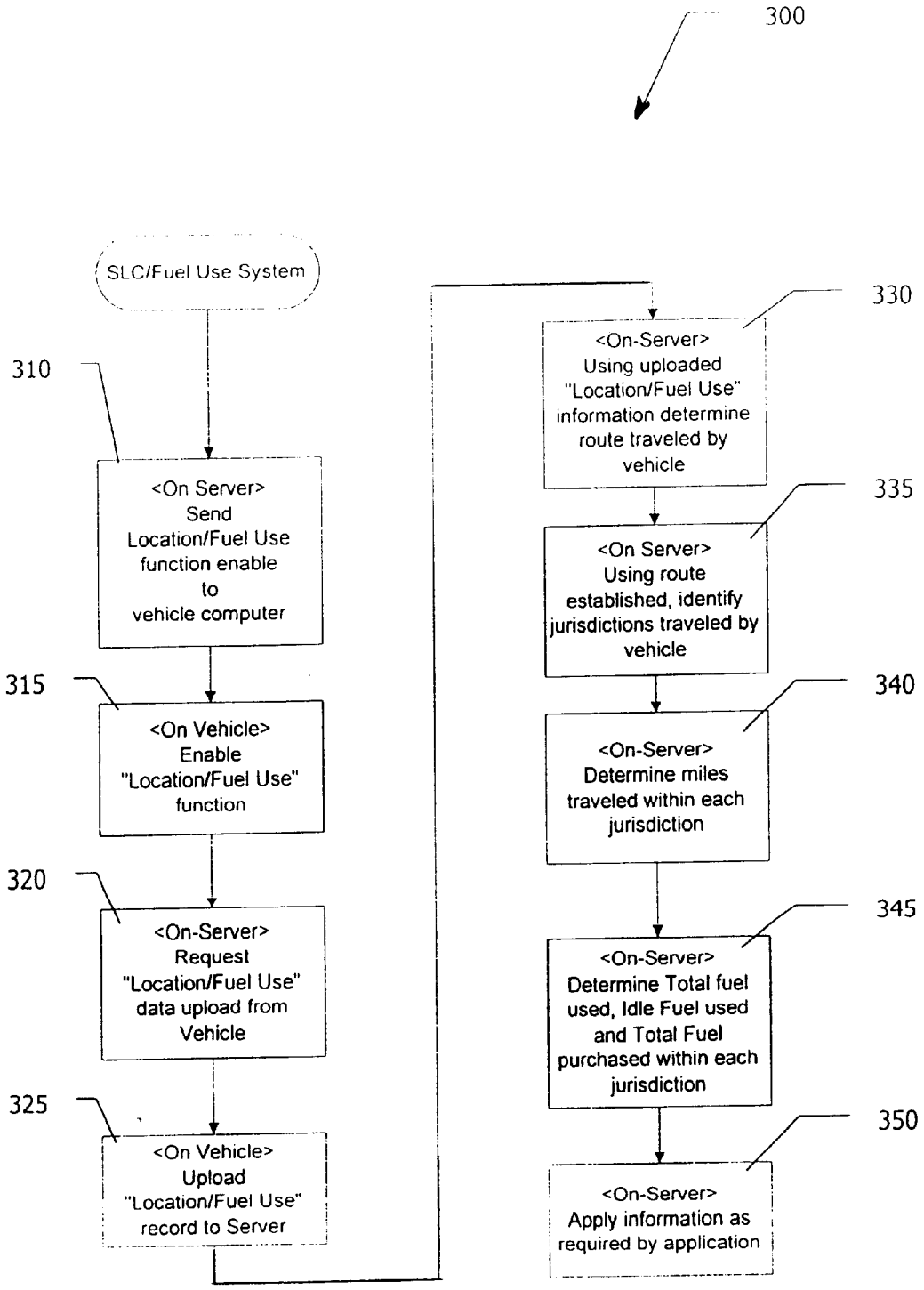
FIG. 3 shows a system flow diagram of the preferred embodiment of the method of the present invention.

Referring now to FIG. 3, the preferred embodiment of the method 300 of the present invention is depicted to illustrate where the various processes are conducted within the system. The method 300 starts in step 310 when the remote server sends a notification to the on-vehicle computer to initialize the location/fuel use function. The on-vehicle computer enables this function, and begins data sampling at step 315. Data sampling involves the on-board computers collecting of unprocessed vehicle data information including the vehicle's longitude and latitude coordinates, bearing, current fuel level, total fuel used, total idle fuel used, and fuel level. The satellite-based positioning system 140 determines the present position of the vehicle in the form of longitude, latitude and bearing data points. These processes are described later, and are depicted in FIGS. 5, 6, 7 and 8.

The on-vehicle data sampling enabled in step 315 continues until the remote server instructs the on-vehicle computer to upload the data to the remote server at step 320, or until the on-vehicle computer data collection device storage is full. When the on-vehicle data collection device storage is full, the on-vehicle computer automatically initiates the process of uploading the data information to the remote server.

At step 320, the remote server instructs the on-vehicle computer to upload the captured unprocessed information to the remote server. At step 325, the on-vehicle computer uploads the information to the remote server, using the available wireless communications link, and in step 330 the remote server processes the vehicle route information by analyzing the latitude and longitude information points provided by the on-vehicle computer to determine the route traveled by the vehicle, placing this information onto an electronic map.

The method 300 continues in step 335, where the remote server performs further analysis of the route plotted in step 330 to determine if any jurisdictional boundaries were crossed by the vehicle. Following, in step 340, the remote server determines the mileage driven in each jurisdiction by using the official mileages published for each route segment. In step 345, the fuel used in each jurisdiction is computed. In step 350 the remote server applies vehicle route and fuel used information as required by an application, for example, fuel consumption information applied to a fuel tax-reporting package. The remote server can then save the information, send this information to any computer, or use this information with another application.

Figure 4:
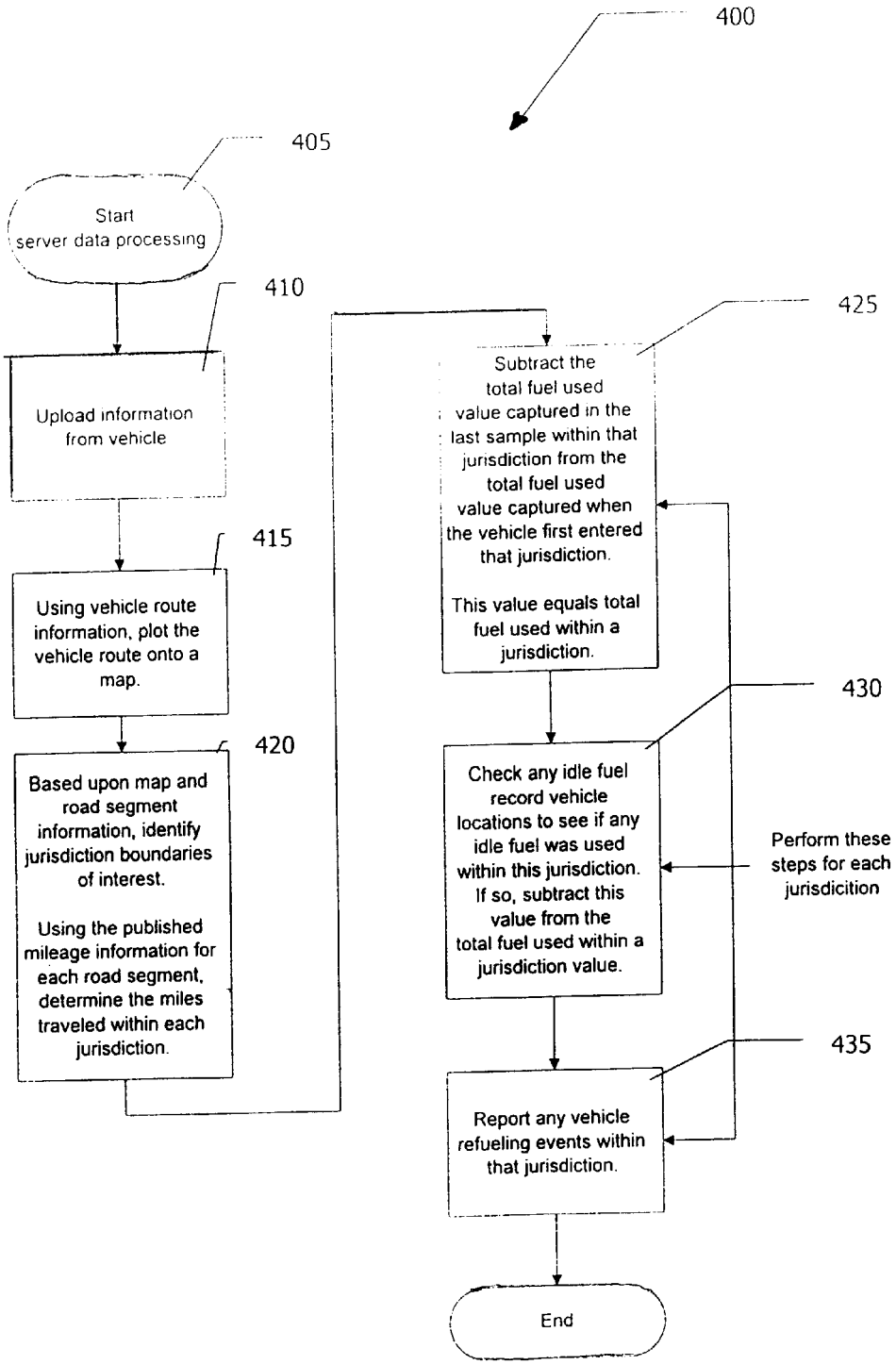
FIG. 4 shows a flow diagram of the preferred embodiment of the remote server data processing function.
Figure 10:
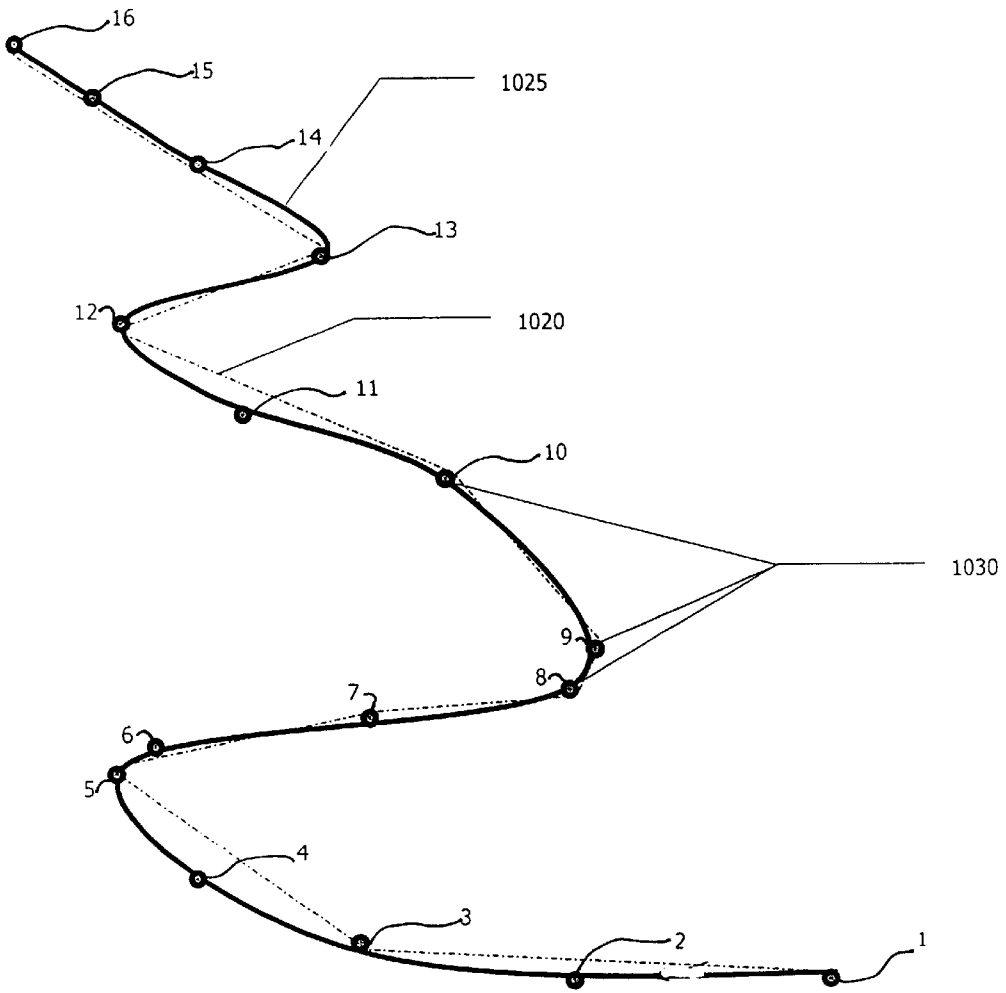
FIG. 10 shows a diagrammatic representation of the method of the current invention where the vehicle route is plotted by the remote server based on collected longitude and latitude information data points.

Referring now to FIG. 4, the system 400 of remote, off-vehicle, data processing is depicted. The process is initiated by the remote server upload request described in step 320, with data processing starting at step 405. At step 410 recorded vehicle information is uploaded by the on-vehicle computer to the remote server. p Once the upload is complete, in step 415 the vehicle route is plotted onto an electronic map. This process identifies the roads and road segments traveled by the vehicle during its trip. To perform step 415, the server plots the vehicle route by positioning the series of latitude and longitude points (1030 in FIG. 10) that were captured by the on-vehicle computer and subsequently uploaded to the remote server onto a series of roads that are identified in an electronic map database that is contained in, or accessible by, the remote server. The captured latitude/longitude position points 1–16 are depicted on the dashed line 1020 in FIG 10. The "route plotted" line based upon placement on a map is depicted in FIG. 10 as a solid line 1025. These example points 1–16 are plotted in FIG. 10 shown as dashed line 1020. The on-vehicle computer has a means of determining which of these captured position points are required to determine the vehicle route. Therefore, not all points shown in FIG. 10 are necessarily sent as records to the remote server.

Referring again to FIG. 4, in step 420, the remote server performs further analysis of the route plotted 1025 in FIG. 10 in step 415 to determine if any jurisdictional boundaries were crossed by the vehicle by using map and road segment information from step 415. Also, step 420 determines the miles traveled within each jurisdiction by using published mileage information from the map database for each road segment traveled within that jurisdiction.

In step 425, the fuel consumption data is analyzed to determine the total and taxable amount of fuel used by the vehicle. This is accomplished by using the unprocessed fuel data collected by the on-vehicle computer at the points near where jurisdictional crossings occurred, and computing the total fuel used in each jurisdiction. To do so, the remote server subtracts the total fuel used value obtained at the point near where the vehicle left the jurisdiction from the total fuel used data near the point the vehicle entered the jurisdiction. This calculation obtains the total fuel used within a jurisdiction value. In step 430 it subtracts the total idle fuel used value obtained near the point where the vehicle left the jurisdiction from the total idle fuel used value obtained near the point the vehicle entered the jurisdiction. This calculation obtains the total idle fuel used within a jurisdiction value. Then, in step 435, using the fuel level information obtained from the on-vehicle computer, the remote server determines the total fuel purchased within the jurisdiction. This information, Total Fuel Used, Total Idle Fuel Used, Total Fuel purchased within a jurisdiction, is then made available to a fuel tax reporting package for further processing. The remote server can then save the information, send this information to any computer for viewing or further processing 125, 130, or use this information for another application.

Figure 5:
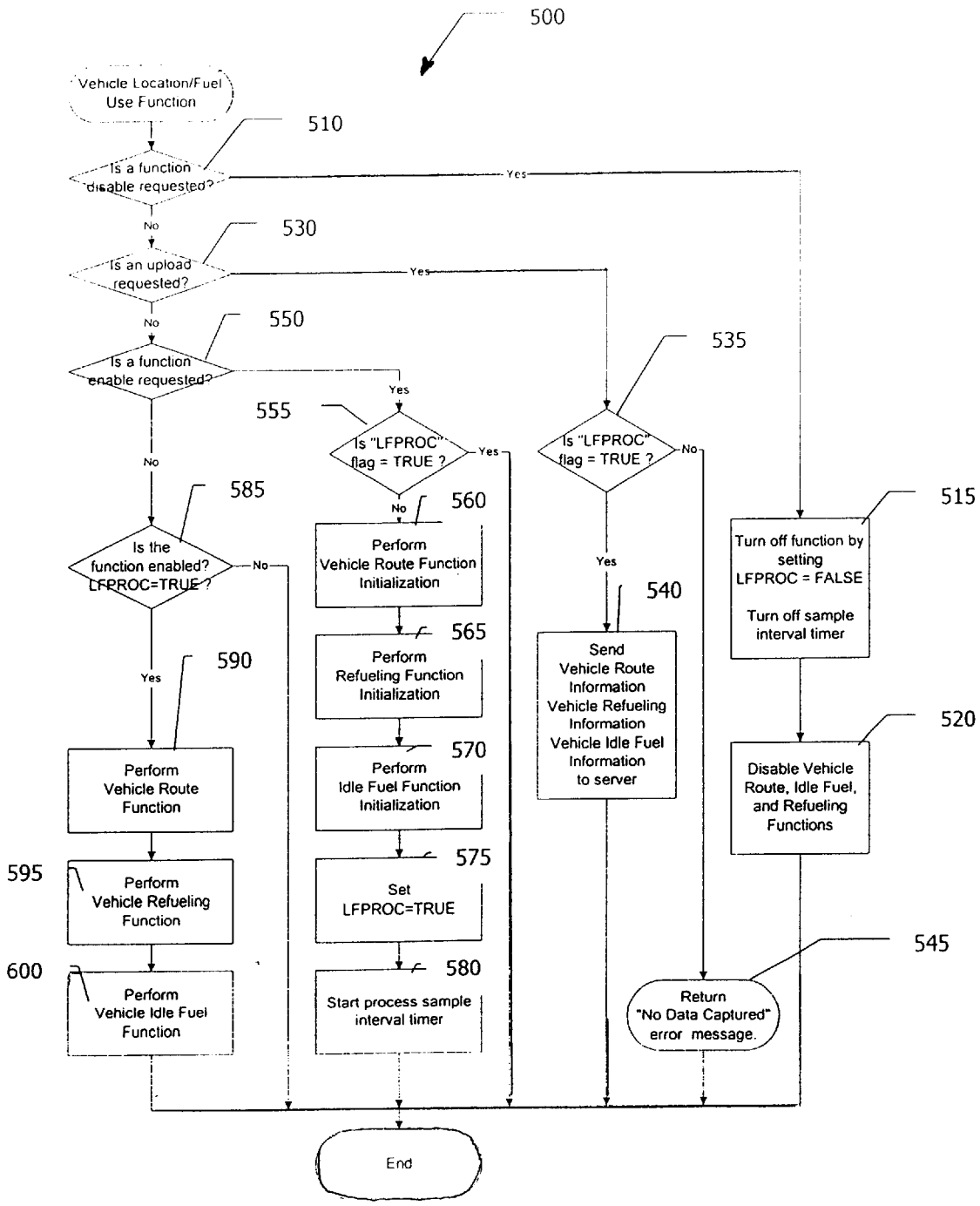
FIG. 5 shows a flow diagram of the preferred embodiment of the on-vehicle data capture process.

Referring next to FIG. 5, a diagram representing the on-vehicle data collection process of the preferred method of the present invention is shown. Specifically, this figure describes the Vehicle Location/Fuel Use function performed on the on-vehicle computer. This function is enabled by receipt of a command from the remote server in step 315 shown in FIG. 3. The vehicle is at a location during the monitoring event. The vehicle can be moving, or stationary, but during the monitoring event the following will occur.

Still referring to FIG. 5, the process of enabling the function begins at step 550. In enabling the function, at step 555 the LFPROC flag is tested to see if the function is already enabled. If so, the function is exited. If the function has not been enabled, it proceeds to step 560 to initialize the vehicle route function, step 565 to initialize the refueling function, and step 570 to initialize the idle fuel function. Each of these functions are described later in the document.

Once these functions are initialized, in step 575 the LFPROC flag is set to TRUE to indicate that the function is ready to record the raw data. At step 580 a process sample interval timer is started. In the preferred embodiment, this sample interval timer is an on-vehicle computer system timer that is set to trigger entry into the function 500 on a ten-second interval. This approach allows the system to perform the functions described in FIGS. 6, 7, and 8 every ten seconds.

Once the function is enabled as described, it is entered on a periodic basis, determined either by the sample interval timer described earlier or by a specific command received from the remote server. The process associated with this function entry begins at step 585. First, the LFPROC flag is tested to see that the function has been enabled, and that periodic sampling is still desired. If not, the function is exited. If so, the function proceeds to call the Vehicle route function at step 590, the Vehicle Refueling function at step 595, and the Vehicle Idle Fuel function at step 600. Each of these functions are described later.

The request for a remote server upload is determined at step 530. At step 535 the function 500 tests the LFPROC flag to ensure that the function was enabled previously, otherwise it is exited with an error message at step 545.

Figure 9:
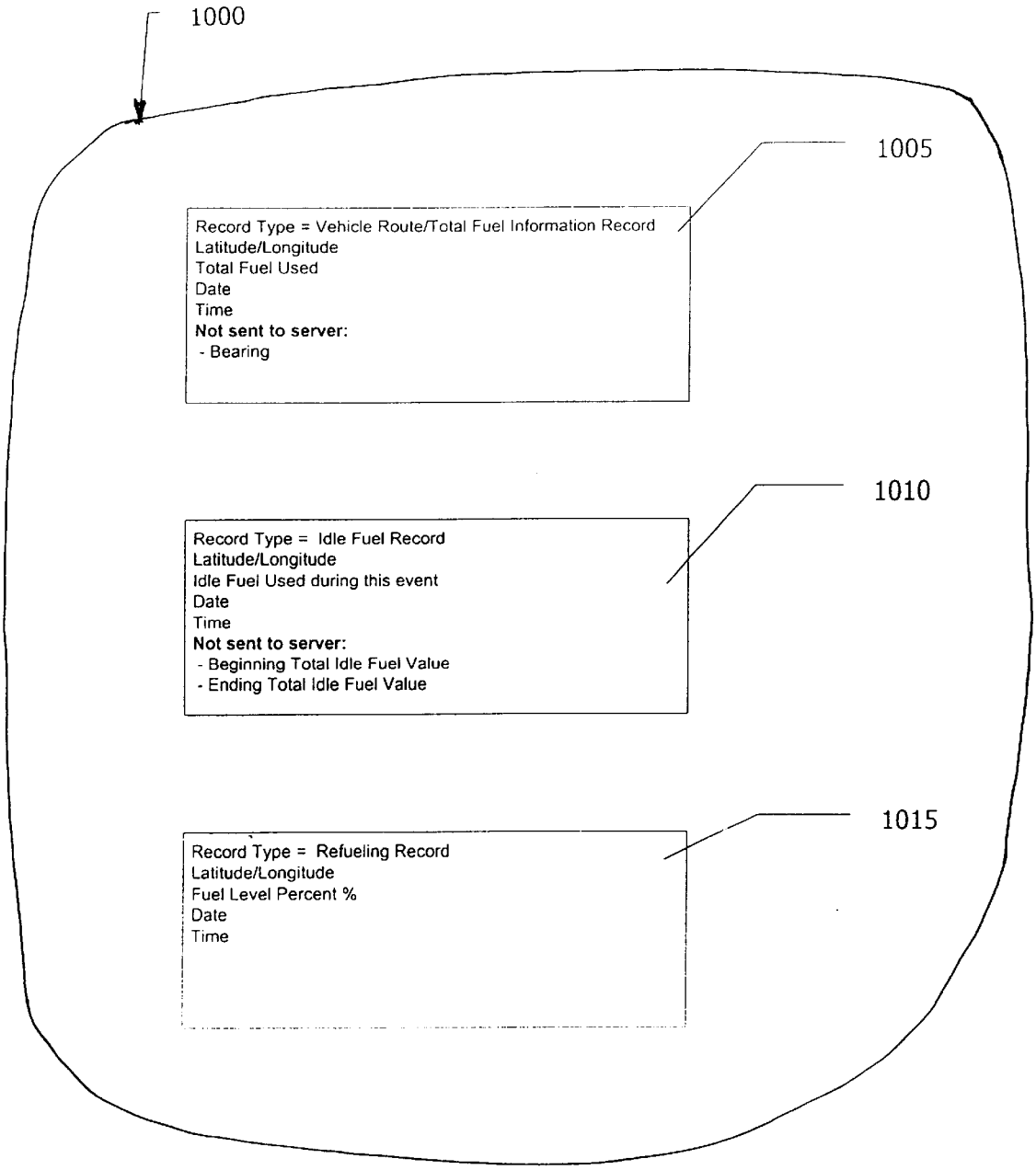
FIG. 9 shows the record types and the information captured by the on-vehicle computer for each record type of the preferred embodiment of the invention.

Referring now to FIG. 9, a representation of the record types and the information captured by the on-vehicle computer is shown. The on-vehicle computer 1000 includes separate date structures for capturing the Vehicle Route/Total Fuel 1005, the Refueling Record 1015, and Idle Fuel 1010. Referring now to FIG. 9 and FIG. 5 together, at step 540, the function 500 proceeds to send the contents of the Vehicle Route/Total Fuel Record table 1005, the Refueling Record Information Table 1015, and the Idle Fuel Record Information Table 1010 to the server. As can be seen in FIG. 9 not all captured information is required by the remote server for data processing. Therefore, the on-vehicle computer sends only the required information, thus optimizing the amount of wireless data that needs to be communicated to the server.

Referring now only to FIG. 5, if the remote server sends a disable request to the function 500, step 510 tests true and the function 500 proceeds to step 515. At step 515 the function is disabled by turning off the sample interval timer, and setting the LFPROC flag to FALSE. In addition, the function 500 disables the Vehicle Route, Idle Fuel, and Refueling functions at step 520. As can be seen by those skilled in the art, in the preferred embodiment, the collection device is an on-board computer. The information is captured on the on-board collection device, and is temporarily stored as unprocessed data. The collection device does not perform any calculation on the data, but rather, holds the data for a short time, until an event occurs which triggers the data to be sent to the remote server.

Figure 6:
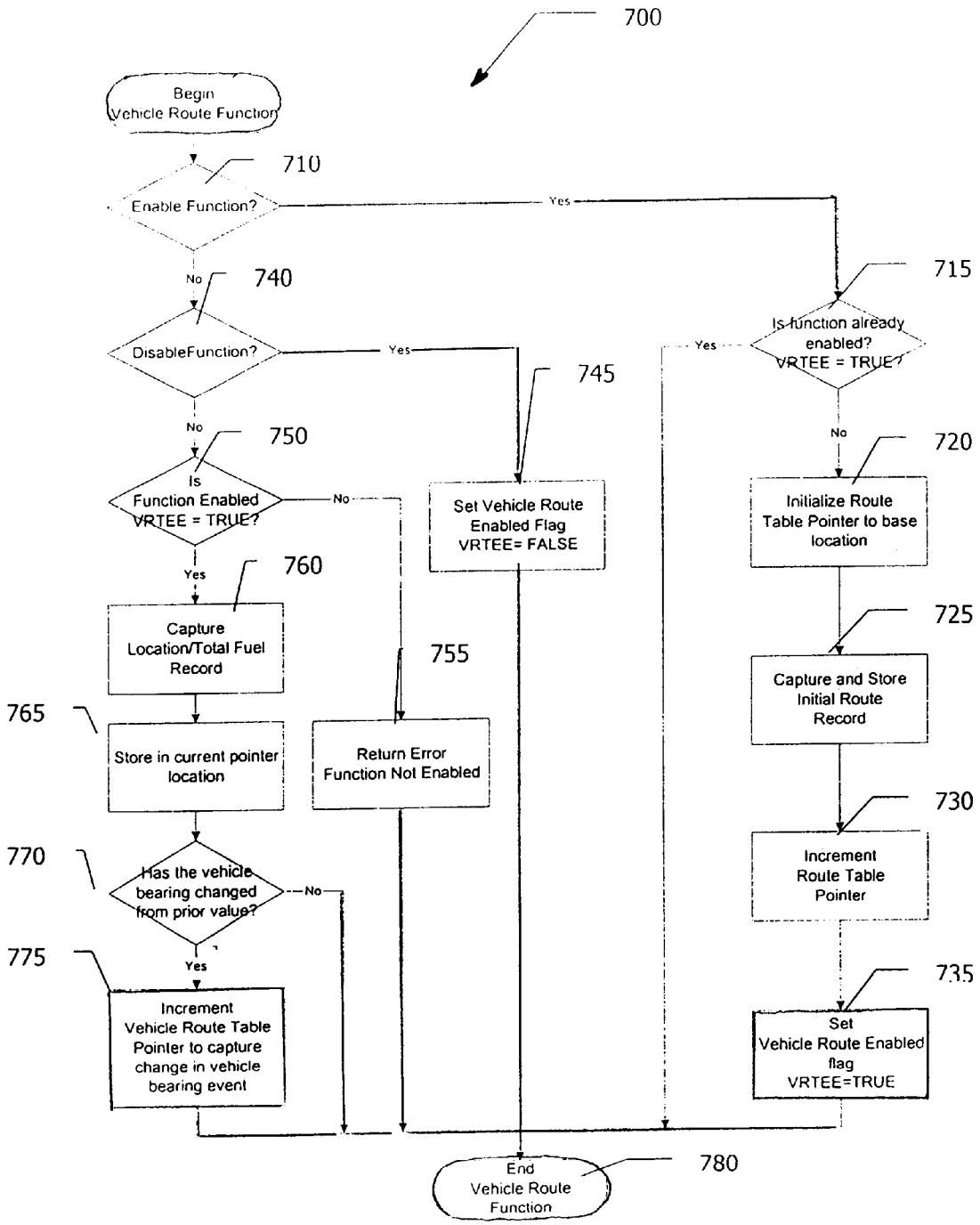
FIG. 6 shows a flow diagram of the preferred embodiment of the on-vehicle route capture function.

FIG. 6 describes the on-vehicle Vehicle Route function 700 performed on the on-vehicle computer. This function is both enabled and reiteratively entered by the on-vehicle Vehicle Location/Fuel Use function.

The fuel data is captured by the on-vehicle computer using one of several fuel PIDs determined by the PIDs available from the existing on-vehicle computer. Since the fuel data is collected at the same time as the position data, these data points correspond to each other. Therefore, the data points collected will allow a user to determine the exact amount of fuel used by vehicle at an exact vehicle position. In the preferred embodiment the total fuel PID, SAE J1587 PID 250 is used, although in other embodiments, the total fuel PID can be obtained from SAE J1939 or alternative data streams. In other embodiments, the total fuel used by the vehicle can be determined using other fuel information PIDs such as SAE J1587 PIDS 183, 184, and 185. These PIDs provide fuel consumption information in various forms: Fuel Rate, Instantaneous Fuel Economy, and Average fuel Economy respectively.

The Total Fuel PID provides fuel information in the form of total fuel used. The Total Fuel PID value can be used to determine the fuel consumed between each data point. Thus, by subtracting the total fuel used values between data points, the total fuel consumed in each vehicle route segment is determined. This information can be divided by jurisdiction to determine the fuel consumed in each jurisdiction.

The process of enabling the function begins at step 710. In enabling the function, at step 715 the VRTEE flag is tested to see if the function is already enabled. If so, the function is exited. If the function has not been enabled, it proceeds to step 720 to initialize the route function table pointer, to step 725 to capture an initial route sample to store as the base or ordinal value, and to step 730 to increment the route table pointer to the next available table location. Once the function 700 is initialized, the VRTEE flag is made TRUE, indicating that the function is fully enabled and operational step 735.

Once the function is enabled as described, it is entered on a periodic basis from the Vehicle Location/Fuel use function. The process associated with periodic entry begins at step 750. First, the VRTEE flag is tested to see that the function has not been disabled, and that periodic sampling is still desired. If not, the function is exited with an error return code step 755. If so, the function proceeds to capture a Vehicle Route/Total Fuel (shown as 1005 in FIG. 9) record at step 760, and store the data at the table location pointed to by the pointer step 765. At step 770, the vehicle bearing information from the current record is tested to determine if the vehicle is maintaining a compass heading that is consistent with the prior record (that is, within a few compass degrees plus or minus). If so, the vehicle is essentially heading in the same direction as the prior sample, i.e. a straight line, thus retention of this sample is not essential and the value is retained until the next sample is captured, at which time it will be written over with the new data. If the vehicle compass heading has changed by a predetermined value in step 770, the function 700 increments the Vehicle Route/Total Fuel Information table pointer in step 775 to preserve this new value as indicative of a change in vehicle course direction. As can be seen by those skilled in the art, this storage process allows the system to accurately track the route of the vehicle while minimizing the actual route information record storage requirements.

Finally, if the remote server sends a disable request to the function 700, step 740 tests true and the function 700 proceeds to step 745. At step 745 the function is disabled by setting the VRTEE flag to FALSE. The function is exited in all cases described above at step 780.

Figure 7:
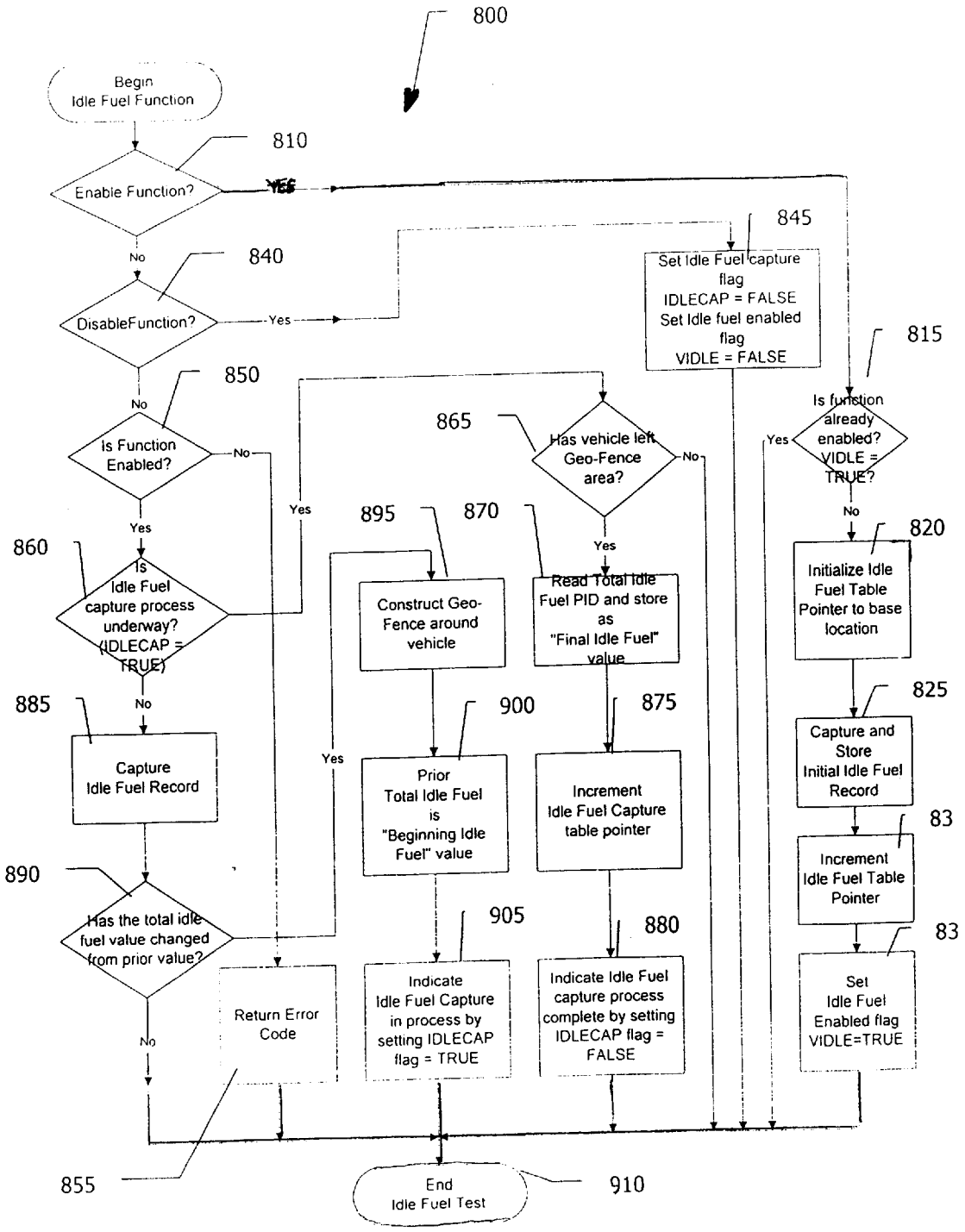
FIG. 7 shows a flow diagram of the preferred embodiment of the on-vehicle idle fuel capture function.

FIG. 7 describes the on-vehicle Idle Fuel function 800 performed on the on-vehicle computer. This function is both enabled and reiteratively entered by the vehicle location/fuel use function. By capturing the total idle fuel consumption values when a vehicle is stationary and idling, the total idle fuel consumed by jurisdiction is determined.

The total idle fuel PID (PID 236) provides fuel information in the form of total idle fuel used. Comparison of the total idle fuel PID values between record samples can be used to determine the total idle fuel consumed between each data point.

The process of enabling the function begins at step 810. In enabling the function, at step 815 the VIDLE flag is tested to see if the function is already enabled. If so, the function is exited. If the function has not been enabled, it proceeds to step 820 to initialize the idle fuel function table pointer, to step 825 to capture an initial idle fuel record to store as the base or ordinal value, and to step 830 to increment the idle fuel table pointer to the next available table location. Once the function 800 is initialized, in step 835 the VIDLE flag is made TRUE, indicating that the function is fully enabled and operational.

Once the function is enabled as described, it is entered on a periodic basis from the Vehicle Location/Fuel use function. The process associated with periodic entry begins at step 850. First, the VIDLE flag is tested to see if the function is enabled. If not, the function is exited with an error return code step 855. If so, the function tests to see if an idle fuel capture process is underway step 860. If an idle fuel capture process is not underway, the function 800 proceeds to capture an idle fuel record 1010 at step 885. At step 890 the function 800 tests the Total Idle Fuel PID value to see if the value has changed from the prior value. If not, the function is exited. If so, the function 800 proceeds to step 895 to construct a Geo-Fence around the vehicle. In this instance a geo-fence is a boundary around the vehicle that is established based upon the current latitude and longitude coordinates of the vehicle. As long as subsequent vehicle position readings indicate that the vehicle has not moved within an established latitude/longitude limit based upon the original value, the vehicle has not moved.

The assumption can be made that if the vehicle is idling, it is not moving. Therefore, if one captures the idle fuel information, constructs a Geo-Fence around the vehicle based upon its GPS coordinates, and periodically tests to see if the vehicle has left the boundaries of the Geo-Fence, one will know when the idle period has ended. When this occurs, by capturing the idle fuel value at that point the difference between the original idle fuel value and the final idle fuel value equals the total amount of idle fuel consumed during that idling event. At step 900 the total idle fuel value captured during the prior sample is stored in this record, indicating the beginning idle fuel value for this location, along with the Total Idle Fuel value, vehicle location, and date and time. This vehicle location information will allow the remote server to determine which jurisdiction the vehicle was in, and when it was in that jurisdiction, during this idling event. The indication of an Idle Fuel event capture process is established in step 905 by setting the IDLECAP flag to TRUE.

Looking at step 860 one can follow the steps of the process 800 in the event where an idle capture process is underway. When an idle fuel capture process is underway, the function 800 proceeds from step 860 to step 865. Here, it tests to see if the vehicle has left the previously constructed geo-fence area. If it has not left the geo-fence area, the function is exited at step 910. If it has left the Geo-Fence area, the function 800 proceeds to step 870 to capture the Total Idle fuel PID and store it in the record pointed at by the idle fuel table pointer as the final Total Idle fuel value. In step 875 the Idle Fuel capture table pointer is incremented to prepare for the next sample, and finally, in step 880, the IDLECAP flag is set to FALSE to indicate that the Idle Fuel capture event is completed. The function 800 exits at step 910.

As can be seen, upon completion of this function the Idle Fuel capture record will contain a complete history of the idle event, including vehicle location, date/time, and total idle fuel consumed.

Figure 8:
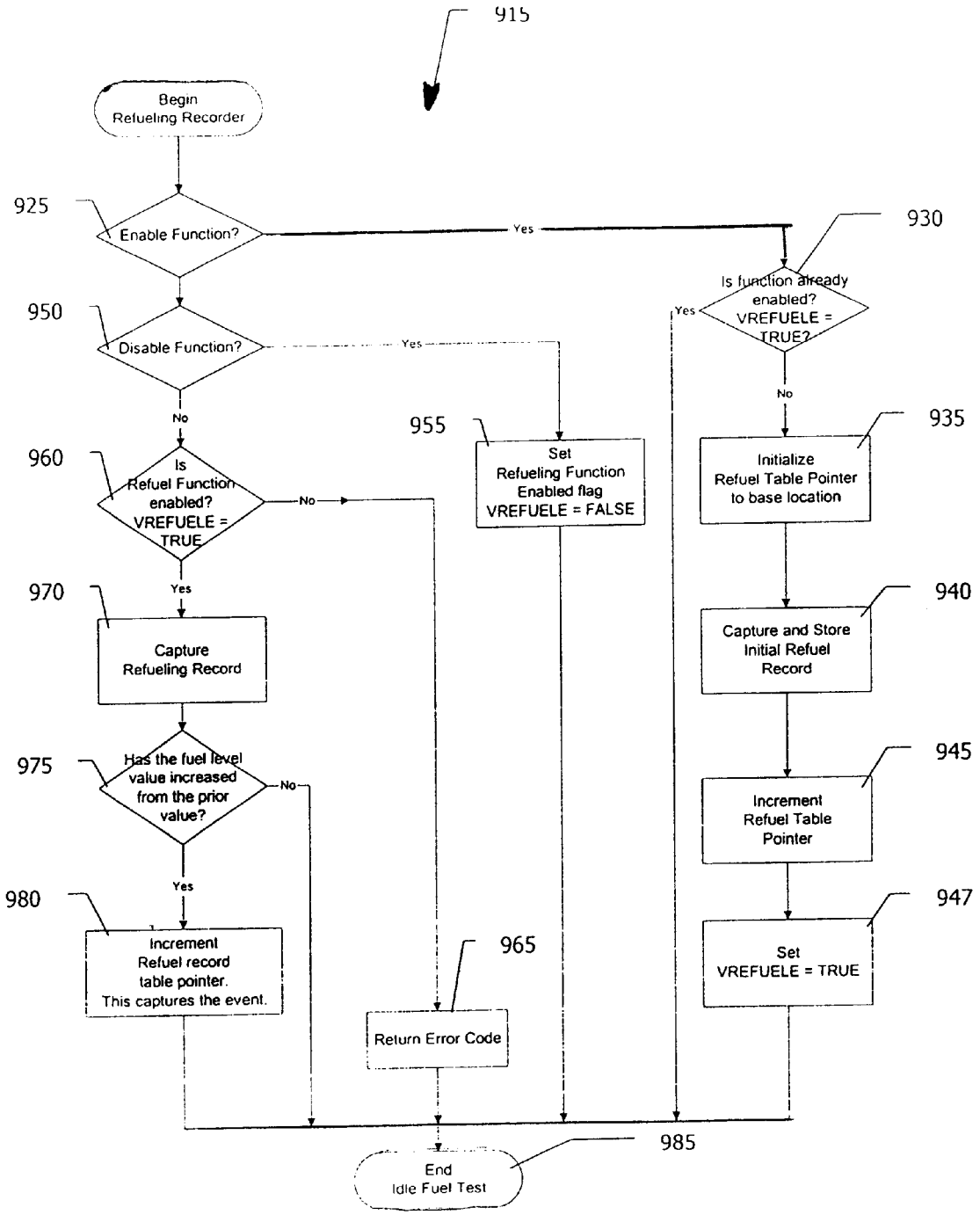
FIG. 8 shows a flow diagram of the preferred embodiment of the on-vehicle refueling event capture function.

FIG. 8 describes the on-vehicle refuel event function 915 performed on the on-vehicle computer. This function is both enabled and reiteratively entered by the on-vehicle vehicle location/fuel use function. In the preferred embodiment of the present invention, the vehicle also includes the fuel level PID, SAE J1587 PIDs 38 or 96, which are used to determine a refueling event. Since these PIDs determine the fuel level of the fuel reservoir in the vehicle as a percentage of capacity, when the data reflects an increase in fuel level, this signals a refueling event.

Still referring to FIG. 8, the process of enabling the function begins at step 925. In enabling the function, at step 930 the VREFUELE flag is tested to see if the function is already enabled. If so, the function is exited. If the function has not been enabled, it proceeds to step 935 to initialize the refueling function table pointer, to step 940 to capture an initial refuel sample to store as the base or ordinal value, and to step 945 to increment the refuel table pointer to the next available table location.

Once the function 915 is initialized, the VREFUELE flag is made TRUE, indicating that the function is fully enabled and operational step 947.

Once the function is enabled as described, it is entered on a periodic basis from the Vehicle Location/Fuel use function. The process associated with periodic entry begins at step 960. First, the VREFUELE flag is tested to see that the function has not been disabled, and that periodic sampling is still desired. If not, the function is exited at step 965 with an error return code. If so, the function proceeds to capture a refueling record at step 970, and store the record at the table location pointed to by the refueling record pointer. At step 975, the vehicle fuel level PID value from the current sample is tested to determine if the vehicle is acquiring fuel. This is indicated by an increase in the fuel level value. If it is determined that the vehicle fuel level has increased, the function 700 shown in FIG. 6 increments the vehicle route table pointer in step 980 to preserve this value as indicative as a refuel event.

Finally, if the remote server sends a disable request to the function 915, step 950 tests true and the function 915 proceeds to step 955. At step 955 the function is disabled by setting the VREFUELE flag to FALSE. The function 915 is exited in all cases described above in step 985.

Although the present invention has been described with reference to certain preferred embodiments thereof, other versions are readily apparent to those of ordinary skill in the art. Therefore, the spirit and scope of the appended claims should not be limited to the description of the preferred embodiments contained herein.

What is claimed is:

1. An electronic monitoring system that determines vehicle position, fuel consumption in a jurisdiction, and jurisdiction crossings, said system comprising:

a vehicle having a fuel reservoir from which fuel is consumed as an energy source;

a positioning system for generating present position information including latitude and longitude information of said vehicle;

a fuel monitoring means in said fuel reservoir, whereby said fuel monitoring means generates information including the present level of fuel in said fuel reservoir;

a data collection device for collecting said present position information and said present level of fuel information; and a processor located remote from said vehicle, said processor receiving from said data collection device at least a portion of said present position information and said present level of fuel information and responsively determining when said vehicle crosses a jurisdiction border and computing said fuel consumption in said jurisdiction.

2. The system claimed in claim 1, wherein said positioning system is a global positioning system receiver.

3. The system claimed in claim 1, wherein said positioning system is a LORAN receiver.

4. The processor claimed in claim 1, wherein said processor receives said information from said data collection device through a wireless network.

5. The fuel monitoring means claimed in claim 1, wherein fuel monitoring means is parameter identification information.

6. The system claimed in claim 1, wherein said positioning device further generates present bearing data of said vehicle.

7. The system claimed in claim 1, wherein said data collection device further collects said bearing data.

8. The system claimed in claim 1, wherein said processor receives said information from said data collection device through a wireless network.

9. The system claimed in claim 1, wherein said positioning system comprises a global positioning system receiver.

10. The system claimed in claim 1, wherein said positioning system comprises a LORAN receiver.

11. The processor claimed in claim 1, wherein said processor receives said data from said data collection device through a wireless network.

12. The fuel monitoring means claimed in claim 1, wherein fuel monitoring means comprises parameter identification information.

13. The system claimed in claim 1, wherein said positioning device further generates present bearing data of said vehicle.

14. The system claimed in claim 1, wherein said collecting device further collects said bearing data.

15. An electronic monitoring system that determines vehicle position, fuel consumption in a jurisdiction, and jurisdiction crossings, said system comprising:

a vehicle having at least one vehicle controller for controlling at least one operation of said vehicle and having a fuel reservoir from which fuel is consumed as an energy source;

a positioning system for generating present position information including latitude and longitude information of said vehicle;

a fuel monitoring means in said fuel reservoir, whereby said fuel monitoring means generates information including the present level of fuel in said fuel reservoir;

a data collection device for collecting from at least one vehicle controller said present position information and said present level of fuel information; and a processor located remote from said vehicle, said processor receives from said data collection device at least a portion of said present-position information and said present level-of-fuel information and responsively (1)

determines when said vehicle crosses a jurisdiction border, and (2) computes said fuel consumption in said jurisdiction.

16. An electronic monitoring system that determines a jurisdictional crossing from a remote location, said system comprising:

a vehicle having at least one vehicle controller for controlling at least one operation of said vehicle;

a positioning system for generating present position information including latitude and longitude information of said vehicle;

a data collection device for collecting from at least one vehicle controller said present position information; and a processor located remote from said vehicle, said processor receives from said data collection device at least a portion of said present-position information and responsively determines when said vehicle crosses a jurisdiction border.

17. The system claimed in claim 16, wherein said positioning system comprises a global positioning system receiver.

18. The system claimed in claim 16, wherein said positioning system comprises a LORAN receiver.

19. The system claimed in claim 18, wherein said processor receives at least a portion of said present-position information from said data collection device through a wireless network.

20. The system claimed in claim 19, wherein said positioning device further generates present bearing data of said vehicle.

21. The system claimed in claim 20, wherein said collecting device further collects said bearing data.

* * * * *